US005860870A

United States Patent [19]

Park

[11] Patent Number: 5,860,870

[45] Date of Patent: Jan. 19, 1999

[54] GOLF BALL SUPPLY SYSTEM

[76] Inventor: Sang Won Park, 23-103 Hanyang Z-cha Apt., 151 Songpa-Dong, Songpa-ku, Seoul, Rep. of Korea

[21] Appl. No.: 979,309

[22] Filed: Nov. 26, 1997

[51] Int. Cl.[6] ..... A63B 57/00

[52] U.S. Cl. ..... 473/136

[58] Field of Search ..... 473/132, 133, 473/134, 135, 136, 137

[56] References Cited

U.S. PATENT DOCUMENTS

| | | | |
|---|---|---|---|
| 4,817,955 | 4/1989 | Hickson et al. | 473/136 |
| 5,282,628 | 2/1994 | Kormori et al. | 473/136 |
| 5,529,307 | 6/1996 | Chang | 473/136 |
| 5,549,517 | 8/1996 | Ikemoto | 473/136 |

*Primary Examiner*—Steven Wong

[57] ABSTRACT

A golf ball supply system which is capable of reducing its failure, increasing its lifetime and performing an accurate operation by improving the switch for sensing the rotating angle of the operation handle of the system and the circuit of the system. The golf ball supply system contains an operating handle which is operated by a selective adjusting angle of a rotating angle control switch, a rotating angle sensing switch and an initial position switch which are composed of lead switches and are respectively installed in predetermined angular positions. A permanent magnetic piece is attached to the rear end of the operation handle so that an IC circuit receives and sorts an ON/OFF signal from the lead switches and the pedal switch and transfers the signal to respective timers. The timers receive the signals from the IC circuit and operate the solenoid through a first switch IC and further receive the signals from the IC circuit and operate the static motor through a second switch IC.

1 Claim, 4 Drawing Sheets

GOLF BALL SUPPLY SYSTEM

BACKGROUND OF THE INVENTION

1. Field of the Invention

The present invention relates to a golf ball supply system which automatically supplies golf balls, one by one, onto a golf tee installed on an in-door brush mat or setting position where a golfer practices the playing of golf. The golf ball supply system is capable of reducing its failure, increasing its life and performing its accurate operation by improving the switch for sensing the rotating angle of the operation handle of the system and the electrical circuit of the system.

2. Description of the Related Art

In a conventional golf ball supply system, a driving motor for carrying golf balls, one by one, onto a predetermined position in order to mechanically supply the golf balls during in-door golf practice is coupled with a solenoid, an IR sensor relay driving circuit and a plurality of switches such as a rotating angle sensing switch, so that an operating handle can be accurately controlled. The conventional system supplies a golf ball on a brush mat or golf tee in the desired position by an automatic supply method using the IR sensor or a semi-automatic supply method using a pedal. Thus, it is possible to effectively practise playing golf using the conventional golf ball supply system, and the system has contributed to the popularization of golf. However, since the sensing of the rotating angle in the system is performed by sensing the contact between the moving operation handle and a fixed limit switch, the limit switch frequently breaks down due to the frequent impacts produced during the repeating process. Further, since the system uses a mechanical relay switch, the contact of the relay switch wears away and thus the relay switch does not accurately function. Thus, there is the problem that the life time of the overall system is decreases.

SUMMARY OF THE INVENTION

The present invention solves the above-mentioned problems of the conventional golf ball supply system and decreases the failure of a golf ball supply system, increases the life time thereof and accurately performs the operation thereof by replacing the conventional rotating angle sensing switch and the mechanical relay switch with a non-contact lead switch and an IC circuit, respectively, in order to provide a non-contact operation.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

Figure 4:
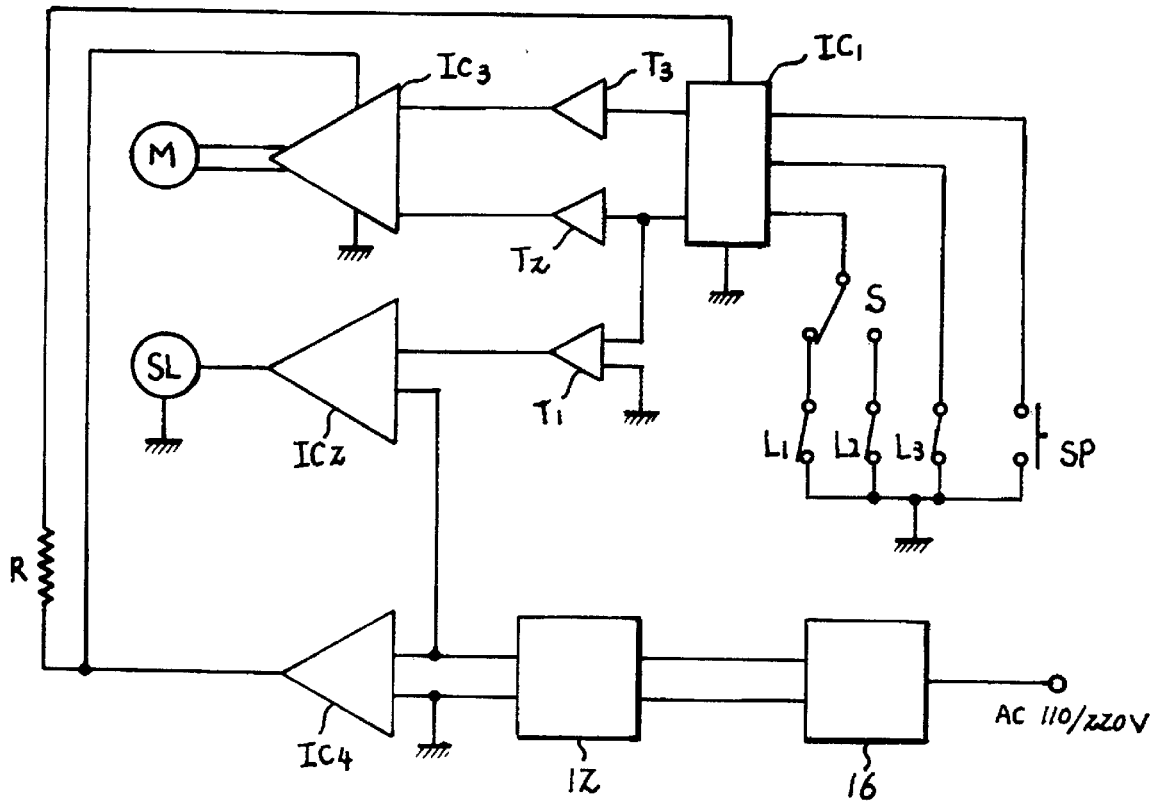
FIG. 4 is a circuit diagram of the golf ball supply system according to the present invention.

The present invention provides a golf ball supply system in which a loading plate 2 and an outlet 3 are installed on a body 1, the rear end of an operating handle 4 is axis-supported with a chain gear 5 operated by a static motor M, the front end of the operating handle 4 is positioned by the end of the outlet 3, a tongs having a fixing element 7 and an operating element 8 are installed on the lower surface of the front end of the operating handle 4, the operating element 8 is connected to the front end of an operating rod 9 inserted within the operating handle 4 while being elastically supported by a spring, the rear end of the operating rod 9 is connected to a mobile rod 10 of a solenoid SL, and the operating rod 9 is operated by the selective adjusting angle of a rotating angle control switch S by operating a pedal switch SP using the solenoid operation. The rotating angle sensing switch and an initial position switch are composed of lead switches $L_1$, $L_2$ and are $L_3$, and respectively installed in predetermined angular positions, and a permanent magnetic element is attached to the rear end of the operation handle 4, so that, as shown in FIG. 4, an IC circuit $IC_1$ receives and sorts an ON/OFF signal from the lead switch $L_1$, $L_2$ and $L_3$ and the pedal switch SP and transfers the signal to respective timers $T_1$, $T_2$ and $T_3$. The timer $T_1$ receives the signal from the IC circuit $IC_1$ and operates the solenoid SL through a switch IC $IC_2$, and the timers $T_2$ and $T_3$ receives the signal from the IC circuit $IC_1$ and operates the static motor M through a switch IC $IC_3$.

The reference numeral 6 is a long opening, element 12 is a rectifier, element 13 is a golf tee, element 14 is a brush mat, element 15 is a circuit board, S is a rotating angle control switch and element 16 is a power transformer.

The operation and effect of the golf ball supply system according to the present invention will be now explained in detail with reference to the drawings.

When the golf ball supply system according to the present invention is used, as in other golf ball supply systems, a commercial power supply is first applied to the system. Then, the rotating angle control switch S is adjusted at a predetermined angle and when the pedal switch SP is pressed by a golfer's foot, the IC circuit $IC_1$ receives an ON signal from the pedal switch SP and transfers the signal to the timer $T_1$ and $T_2$.

Then, the timer $T_1$ transfers the signal to the switch IC $IC_2$ and the switch IC $IC_2$ is turned on, so that the solenoid SL is operative.

At this time, the mobile rod 10 of the solenoid SL is instantaneously drawn and the operating element 8 is also drawn by the operating rod 9, so that a golf ball at the front end of the outlet 3 is held between the fixed element 7 and operating element 8 of the tongs.

At the same time, the timer $T_2$, which receives the signal from the IC circuit $IC_1$ at the time when the timer $T_1$ receives the signal from the IC circuit $IC_1$, delays the signal received from the IC circuit $IC_1$ during a time interval when the tongs hold the golf ball by using the solenoid SL. After the tongs are holding the golf ball, the timer $T_2$ transfers the signal to the switch IC $IC_3$ and the switch IC $IC_3$ connects the power supply to the static motor M, so that the static motor M can be operated in the positive direction.

Therefore, since the static motor M is connected with the chain gear through a chain, when the chain gear 5 is rotated, the operating handle 4 installed on the same axis as the axis of the gear 5 is also rotated at a predetermined angle along the long opening 6 of the body 1 by the rotating angle control switch S.

Figure 1:
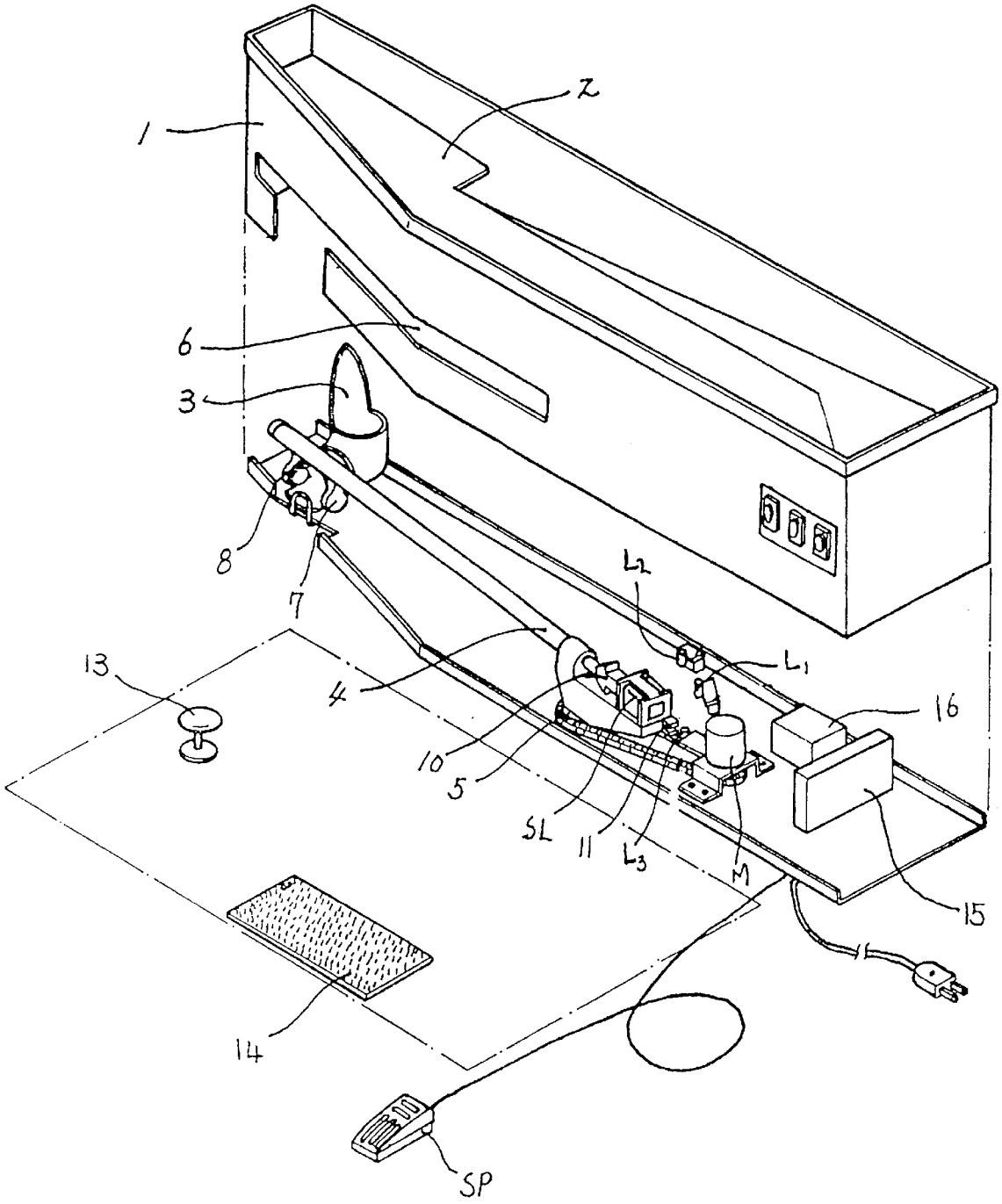
FIG. 1 is a partially exploded overall perspective view showing the golf ball supply system according to the present invention.
Figure 2:
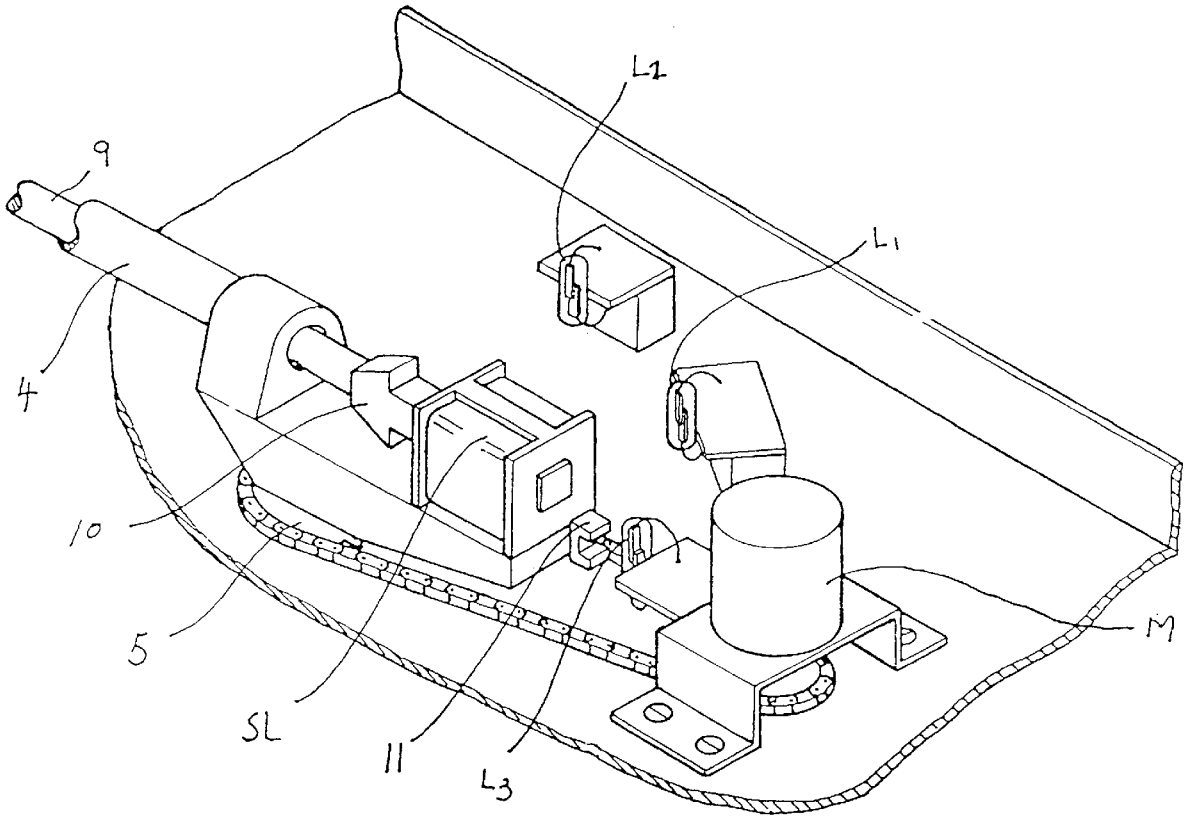
FIG. 2 is an enlarged view illustrating the main parts of the golf ball supply system according to the present invention.
Figure 3:
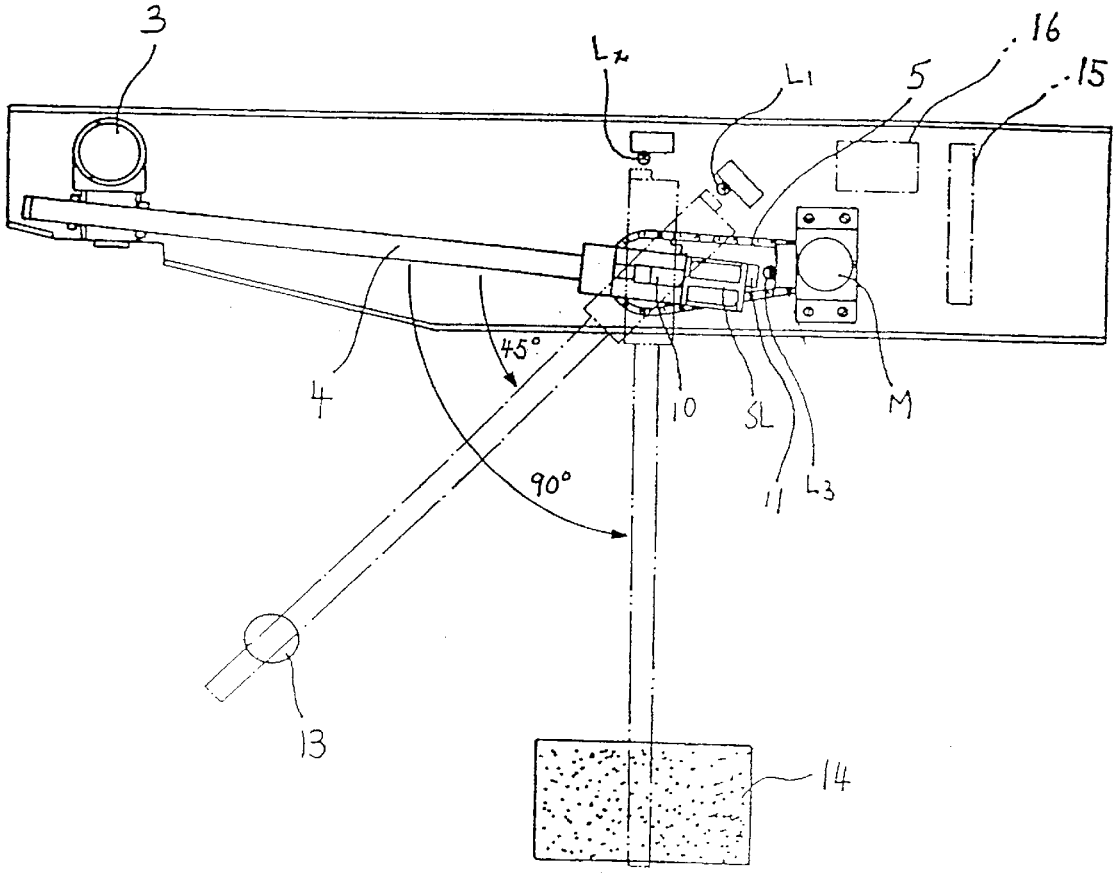
FIG. 3 is a plan view illustrating the rotational operation of the operating handle of the golf ball supply system according to the present invention.

At this time, the rotation of the operating handle 4 is continued until any one of the lead switches $L_1$ and $L_2$ selected by the rotating angle control switch S is turned off by the operating handle 4. That is, when the lead switch $L_1$ is selected by the rotating angle control switch S, as shown in FIG. 3, the lead switch $L_1$ is turned off at an time when the operating handle 4 is rotated at the angle of 45 degrees to the position of the golf tee 13. On the other hand, when the lead switch $L_2$ is selected by the rotating angle control switch S, the lead switch $L_2$ is turned off at the time when the operating handle 4 is rotated at an angle of 90 degrees to the position of the brush mat 14.

As described above, the off signal is transferred to the IC $IC_1$, the IC $IC_1$ transfers the signal to the timer $T_1$, $T_2$ and $T_3$ and the timer $T_2$ transfers the signal to the switch IC $IC_3$, so that the static motor M is disconnected from the power supply and stops rotating. On the other hand, the timer $T_1$, which concurrently received the signal, delays the signal by a predetermined time interval and then transfers the signal to the switch IC $IC_2$ so that the solenoid SL is disconnected from the power supply. Therefore, the operating element of the tongs is returned to its original position by the restoring force of the spring inserted within the operating handle 4, the golf ball is extracted from the tongs and placed onto the golf tee 13 or the brush mat 14. At this time, the timer T3, which concurrently received the signal, delays the signal until the operating handle 4 is stopped and a golf ball is placed onto the golf tee 13 or the brush mat 14 by the operation of the solenoid SL, and then transfers the signal to the switch IC $IC_3$.

When the switch IC $IC_3$ receives the signal from the timer $T_3$, the power supply is connected to the static motor M in the negative direction and the static motor M is rotated in the negative direction. Thus the lead switch $L_3$ is turned off by the returned operating handle 4. Therefore, the IC circuit $IC_1$ receives the off signal of the lead switch $L_3$ and turns off the switch IC $IC_3$, so that the operating handle 4 stops rotating and is initialized.

That is, when another golf ball is needed after a golfer tees the golf ball up on the golf tee 13, the golfer presses the pedal switch SP with a foot and the system supplies a new golfer ball onto the golf tee 13, so that it is not required that the golfer place a golf ball onto the golf tee 13 by himself. This permits the golfer to continuously practice playing golf.

In the golf ball supply system according to the present invention, since the circuits and switches have no contact position, the system doesn't break down during the repeating operation which is accurately operated. Further, with the system of the present invention, it is possible to reduce personnel expenses, system costs and maintenance costs in the management of golf driving ranges.

The invention being thus described, it will be obvious that the same may be varied in many ways. Such variations are not to be regarded as a departure from the spirit an scope of the invention, and all such modifications as would be obvious to one skilled in the art were intended to be included within the scope of the following claims.

What is claimed is:

1. A golf ball supply system comprising:

a body containing a loading plate and an outlet disposed therein, an operating handle which is axis-supported and operated by a static motor which is installed at the rear end of said operating handle, tongs having a fixed element and an operating element installed on the lower surface of the front end of said operating handle, said operating element being connected to a mobile rod of a solenoid by an operating rod which is inserted within said operating handle, said operating handle being operated by a selective adjusting angle of a rotating angle control switch by operating a pedal switch, a rotating angle sensing switch and an initial position switch composes of a plurality of lead switches and respectively installed in predetermined angular positions, and a permanent magnetic element attached to the rear end of said operation handle so that an IC circuit receives and sorts an ON/OFF signal from said lead switches and the pedal switch, and transfers the signal to respective first, second and third timers, said first timer receiving the signal from the IC circuit and operating said solenoid through a switch IC and the second and third timers receiving the signal from the IC circuit and operating said static motor through the switch IC.

* * * * *